US008752906B2

(12) United States Patent
Klabisch et al.

(10) Patent No.: US 8,752,906 B2
(45) Date of Patent: Jun. 17, 2014

(54) MINING PLOUGH FOR PLOUGH SYSTEMS AND PLOUGH SYSTEM FOR INCLINED FORMATION

(75) Inventors: Adam Klabisch, Dortmund (DE); Norbert Hesse, Bochum (DE); Gerhard Siepenkort, Lunen (DE); Klaus Duhnke, Werne (DE); Diedrich Bettermann, Unna (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 242 days.

(21) Appl. No.: 13/265,112

(22) PCT Filed: Apr. 16, 2010

(86) PCT No.: PCT/IB2010/051673

§ 371 (c)(1), (2), (4) Date: Oct. 18, 2011

(87) PCT Pub. No.: WO2010/122465

PCT Pub. Date: Oct. 28, 2010

(65) Prior Publication Data

US 2012/0032495 A1 Feb. 9, 2012

(30) Foreign Application Priority Data

Apr. 21, 2009 (DE) ..... 10 2009 003 807

(51) Int. Cl.
*E21C 27/34* (2006.01)

(52) U.S. Cl.
USPC ..... 299/34.04; 299/34.08

(58) Field of Classification Search
USPC ..... 299/34.01, 34.02, 34.08, 34.11, 42
See application file for complete search history.

(56) References Cited

U.S. PATENT DOCUMENTS

| | | | | |
|---|---|---|---|---|
| 3,379,476 | A | 4/1968 | Erwien et al. | |
| 3,703,315 | A * | 11/1972 | Trolley | 299/34.1 |
| 3,804,465 | A * | 4/1974 | Ostrop et al. | 299/34.12 |
| 3,847,438 | A * | 11/1974 | Huttenbrauck et al. | 299/34.08 |
| 4,179,161 | A * | 12/1979 | Breuer et al. | 299/34.03 |
| 4,280,733 | A | 7/1981 | Rassmann et al. | |
| 2007/0090677 | A1 | 4/2007 | Bettermann et al. | |
| 2010/0263569 | A1 * | 10/2010 | Klabisch et al. | 104/173.1 |

FOREIGN PATENT DOCUMENTS

| | | | |
|---|---|---|---|
| DE | 1208269 | B | 1/1966 |
| DE | 1208269 | B | 1/1966 |
| DE | 1259814 | B | 2/1968 |
| DE | 1433226 | A1 | 10/1968 |
| DE | 1433226 | A1 | 10/1968 |
| DE | 1583055 | A1 | 4/1970 |
| DE | 2709392 | A1 | 9/1978 |
| DE | 3245515 | A1 | 6/1984 |
| SU | 478115 | A1 | 7/1975 |

* cited by examiner

*Primary Examiner* — John Kreck
(74) *Attorney, Agent, or Firm* — Foley & Lardner, LLP

(57) ABSTRACT

A mining plough for plough systems for the exploiting of minerals in inclined formations. In order to provide a mining plough and a plough system, with which coal seams, in particular seams in steep formation can be exploited economically and with high operating safety, the mining plough includes a separable plough body having two plough body basic elements each being provided with a fixture for a separate traction means and with a guide means for moving the coal plough by means of at least two traction means and for guiding the coal plough on at least two mutually spaced guide mechanisms.

30 Claims, 4 Drawing Sheets

MINING PLOUGH FOR PLOUGH SYSTEMS AND PLOUGH SYSTEM FOR INCLINED FORMATION

The invention relates to a mining plough for plough systems for the working of coal or minerals in inclined formation, in particular for the working of coal seams in steep formation, having a fixture for fastening at least one traction means for the movement of the mining plough and having at least one guide means for guiding the mining plough on a guide mechanism of the plough system. The invention also relates to the plough system for the working of minerals in inclined formation, in particular for the working of coal seams in steep formation, having a mining plough, having at least one traction means for the movement of the mining plough along a coal face, and having a guide mechanism, which is placed or placeable along a coal face and on which the mining plough is forcibly guided by means of guide means.

BACKGROUND OF THE INVENTION

In the last two decades, the automatic mechanization of the working of flat-stratified coal seams with 0-20 gon (0 to 18 degrees) dip and slightly inclined deposits with 20-40 gon (18 to 36 degrees) dip has led to outputs of up to 1500 t/h with mining ploughs in plough systems and of over 2600 t/h with shearers. Nowadays, the volume of coal which is worked underground stems more than 90% from flat or slightly inclined deposits, since with existing mining technology these can be worked considerably more economically than coal seams or other mineral seams in heavily inclined formation with more than 40 gon (36 degrees) dip, or in steep formation with 60 gon to 100 gon (54 to 90 degrees) dip.

For the working of coal in inclined formation, in particular in steep formation, mostly baseplate plough systems or portal-type plough systems have most recently been used, and DE 32 45 515 C2 describes by way of example a plough system for the working of steeply stratified coal seams with a dip of more than 60°. In this baseplate plough system for steep formation, the guide mechanism consists of a chain channel profiled roughly in a C-shape, in which the plough baseplate engages with a guide block.

SUMMARY OF THE INVENTION

An object of the invention is to provide a mining plough and a plough system, with which mining deposits, in particular coal seams, including semi-steep inclined seams and, in particular, seams in steep formation, can be exploited economically and with high operating safety.

This object and others are achieved according to the invention, with respect to the mining plough, by the fact that the mining plough has a separable plough body having two plough body basic elements, each plough body basic element being provided with a fixture for a separate traction means for moving the coal plough by means of at least two traction means and, in addition, with a guide means for guiding the coal plough on at least two mutually spaced guide mechanisms. The mining plough according to the invention is hence no longer moved parallel to the coal face only by means of one traction means, as is normally the case in the prior art, but by means of two traction means. At the same time, each of the two plough body basic elements is guided with guide means on a separate guide mechanism, whereby a uniform guidance of the separable plough body is achieved overall. As a result of the divisibility of the plough body, which divisibility is preferably provided according to the invention, it is possible in a relatively simple manner, by conversion of the plough body, as will be more fully explained further below, to successfully adapt to another working height, so that, through the reusability of the same elements for the working of mining deposits, in particular coal seams, of different thickness, the operating efficiency of the mining plough according to the invention is improved.

For the working of mining deposits of different working height with the mining plough according to the invention, it is particularly advantageous if the plough body basic elements can be connected directly to each other by means of fastening means to form a plough body having a first working height. Moreover, the connection of the two plough body basic elements by means of the fastening means to form a sufficiently stable plough body makes the underground inbound and outbound transport of the plough body and, in particular, also the assembly in the steep deposits, considerably easier, since the weight of the plough body is at least halved by the division into the two plough body basic elements. In order to increase the operating efficiency of the mining plough, it is further advantageous, if at least one plough body intermediate element is provided, which can be connected to the two plough body basic elements by means of fastening means, to form a plough body having a working height which is greater than the working height of a plough body consisting just of the fastened together plough body basic elements. Through the choice of different plough body intermediate elements, or else through the stringing together of a plurality of mutually identically constructed plough body intermediate elements, the design of the mining plough allows the plough body to be set step-by-step to different working heights, and thus to different thicknesses of the mining deposits to be worked. Expediently, both each plough body basic element and, where present, each plough body intermediate element has locking means for the fastening means, in order that, through the interplay of fastening means and locking means, a virtually rigid plough body consisting of the two plough body basic elements, or a combination of both the two plough body basic elements with at least one plough body intermediate element, can be constructed. Since the plough body intermediate elements are installed between the plough body basic elements, although the guide mechanism has to be adapted, the support or guidance of the mining plough is always realized on both outer sides. A plurality of plough body intermediate elements can also be present, in which case the plough body intermediate elements are detachably connected or connectable one to another, and the plough body basic elements are detachably connected or connectable to the plough body intermediate elements by means of similar fastening means, so that underground only one type of fastening means has to be stocked for the construction of a mining plough of different structural height and only one type of fastening means has to be produced.

In a particularly preferred embodiment of a mining plough according to the invention, the fastening means consist of U-shaped clamps, which can be clamped by means of clamping screws against top and bottom sides on the plough body basic elements or the plough body intermediate elements and, in the assembled state, overlap the dividing plane between these, i.e. between the elements to be joined together. In the particularly preferred embodiment of corresponding fastening means, the clamps have clamping branches having wedge-shaped, mutually facing clamping surfaces, and the locking means are provided with wedge bevels for interaction with the clamping surfaces. When a pair of U-shaped clamps are clamped together, the plough body elements which are to be joined together can then, by means of the clamping surfaces and the wedge bevels, be clamped together perpendicular to the dividing plane with sufficient holding forces and, to this end, it is sufficient to respectively reduce the distance between the clamps. In a particularly advantageous embodiment, the fastening means can comprise a pair of clamps, the distance between which is variable by means of a clamping screw, whose shank, in the assembled state, is disposed in the dividing plane between the plough body elements to be connected. Such a mutual connection of two elements of a plough body can not only be provided in an easily accessible manner on the top sides and/or bottom sides of the plough body, but also offers the possibility, even in case of wear, of being able to tighten the fastening means with sufficient force and to successfully clamp together two elements which are to be connected.

A mining plough according to the invention preferably respectively consists of plough body basic elements, which have an outer side, on which the associated guide means interacting with the guide mechanisms are disposed, and an inner side, which forms the dividing plane and to which the other plough body basic element or a plough body intermediate element can be fastened. In the particularly preferred embodiment, the plough body has on each of the two outer sides a pair of guide means, namely a front guide means and a rear guide means, and, in addition, the guide means disposed on the opposite outer sides should be arranged in pairs one opposite the other. As a result of the even distribution of four guide means in all, namely two front guide means and two rear guide means, over the plough body on the outer sides, even if the loads upon the plough body should vary, a favorable support of the mining plough on the guide mechanisms, in particular an advantageous three-point support or three-point mounting of the plough body, can be achieved. Compared to the guidance principle known from the prior art, for example a portal-type guidance or a plough baseplate guidance, not only are the torques generated in the work effort kept low, but this also results, at the same time, in the plough body as a whole being able to be made narrower, less powerful and thus less weighty in design, which once again leads to a cheaper construction of the mining plough and to improved characteristics in working use. According to a particularly advantageous embodiment, the guide means on each outer side consist of slide runners, which are fastened to the plough body basic element movably, in particular pivotably about a bearing journal or pivot pin. The front and rear guide means can then be mutually aligned to be able to prevent the mining plough from jamming, even in the event of varying forces opposite to the motion of the mining plough. It is further advantageous if the plough body basic elements have on the outer side a extension, which extends rearwards, as an extension of the plough body basic element, beyond the dividing plane or the connecting region of a plough body basic element on the inner side, the, in the motional direction, rear one of the two guide means of each plough body basic element being fastened to the extension preferably such that it is pivotably movable. In addition, the fixture for the respective traction means can then also be configured on this extension in order to achieve not only a favorable force transmission, but also a compact construction of the plough body.

In order to still further improve the modus operandi of the plough system in working use, each plough body basic element can be provided with a mounting flange for a driving element for minerals. Such a driving element can optionally be fitted on one side in order, in the empty run to the evacuation section, to transport material in the pan downwards should individual rock fragments or mineral fragments or the like, despite a steep dip, be wedged or stuck in the pan. The mounting flange can be disposed, in particular, on a bottom side of the plough body basic element, preferably roughly in the middle, between both bearing points for the guide means, and/or can lie adjacent to the fixture for the traction means.

In order to work deposits, such as, for example, coal seams with a mining plough according to the invention, the mining plough, in a manner which is known per se, must be provided with machining tools, in particular ploughing tools. For this purpose, on each plough body basic element and, where present, on each plough body intermediate element, there is expediently configured at least one holding device for the detachable fastening of ploughing tools and/or for the detachable fastening of a tool strip for ploughing tools. The ploughing tools and the tool strip for the ploughing tools are here normally disposed on the front side of the plough body. In order to improve the operating characteristics of the mining plough according to the invention and to better match it to the anticipated loads in mining operation, the ploughing tools close to the inner sides of the plough body basic elements and/or the ploughing tools on the plough body intermediate elements can be set back relative to the ploughing tools on or close to the outer sides of the plough body basic elements. Particularly advantageous is an arrangement of ploughing tools on the front side, which arrangement runs, distributed over the height of the plough body, roughly in a W-shape.

In the working of coal seams in steep formation, the ploughing, in contrast to the working of coal seams in flat formation, is not realized by a reversing mining activity of the mining plough, but rather the extraction of coal takes place exclusively during the upward motion, counter to the dip, from a belt or evacuation section of an underground mining system to the head section, on which, in particular, the drives for the mining plough are also disposed. The rearward motion of the mining plough back to the evacuation section is realized as an empty run without mining activity, and during the empty run the mining plough is transported back into the starting position close to the evacuation section. The coal planed off from bottom to top in the mining run can be evacuated without a mechanically operated conveyor via slides, since, from a dip of about 25 gon (22.5 degrees), a sufficient tipping-over of the slide or slide channel is obtained, which causes extracted materials to slide down automatically to the evacuation section. In order to ensure a wear-free empty run, it is particularly advantageous if each plough body basic element is provided with a pivotable ploughing tool carrier for the reception of ploughing tools or a ploughing tool strip, all the ploughing tools assigned to a plough body basic element preferably being locked or lockable to the pivotable ploughing tool carrier. As a result of the pivotability of the ploughing tool carriers, the ploughing tools, during the empty run, can be pivoted virtually automatically into a position in which not only do the tool tips of the ploughing tools receive no contact with the material to be worked, but also, at the same time, the overall width of the plough body is less than in the mining run, so that the worked deposit offers, in principle, no resistance to the empty run.

The above objects are achieved in a plough system according to the invention by the fact that the mining plough has a separable plough body having two plough body basic elements, each plough body basic element being provided with a fixture for a separate traction means and with a guide means, and, in addition, the guide mechanism of the plough system having two guide bars, which are arranged at a distance apart and substantially at equal distance to the coal face and on which the plough body is forcibly guided with its guide means. The mining plough which is preferably usable on a plough system according to the invention has a plough body having the structure described further above. The arrangement of the guide mechanisms substantially in parallel and at equal distance to the coal face ensures a torque-free support of the plough body, since, in contrast to a baseplate plough, no unilateral, but rather a bilateral plough body support is realized. Each plough body basic element can have, in particular, a front and a rear guide means, the front and the rear guide means being fastened in a pivotably movable manner to each plough body basic element, and at least the rear guide means, in the assembled state, interacting with the guide bars with motional play in order that the plough body, in working use, receives a three-point support via three of the four guide means. The guide mechanism for a plough system according to the invention for the working of steeply stratified deposits can have, in particular, a roughly angular or L-shaped pan, the lower guide bar being fastened to a first branch disposed on the floor, and the upper guide bar being fastened by a cantilever arm to a second branch of the pan running angled-off from the lower branch. In this embodiment, the pan can at the same time also form the slide for evacuating the material extracted with the mining plough.

Further advantages and embodiments of a mining plough according to the invention and of a plough system according to the invention emerge from the following description of a preferred illustrative embodiment, shown in the drawing, of a plough system and a coal plough.

Further, these and other objects, aspects, features, developments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figure 1:
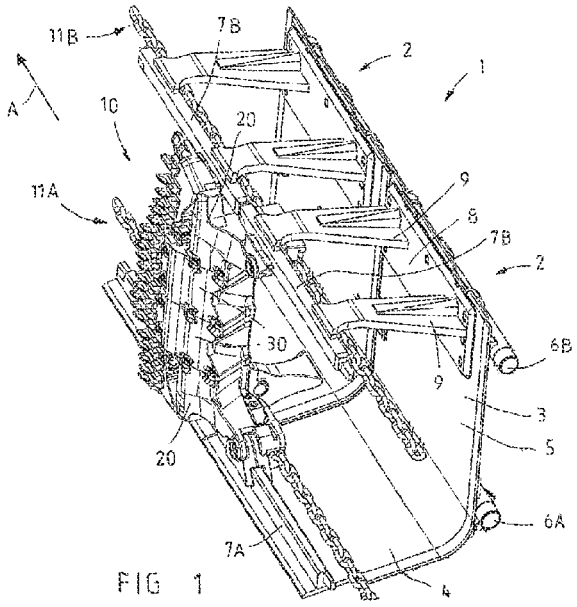
FIG. 1 shows in perspective representation a detail from a plough system according to the invention with mining plough according to the invention.
Figure 2:
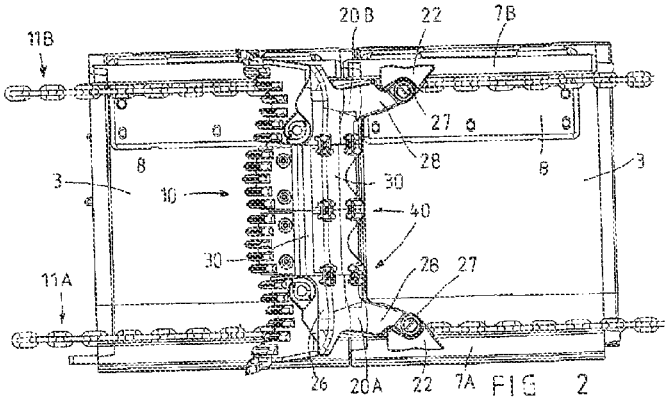
FIG. 2 shows a side view of the plough system from FIG. 1, in a view of the top side of the mining plough, which top side faces the working face.

Referring now to the drawings wherein the showings are for the purpose of illustrating preferred and alternative embodiments of the invention only and not for the purpose of limiting same, in FIGS. 1 and 2, a plough system for the extraction of coal in an underground, steeply stratified coal seam with a dip of, for example, more than 45 gon (40.5 degrees) is denoted in its entirety by the reference symbol 1. The plough system 1 is placed in the steeply stratified deposit parallel to the coal face, hence at an angle to the horizontal, and consists of a multiplicity of trough pans 2 constructed identically to one another and comprising, inter alia, angular pans 3, whereof the, in the figure, lower branch 4 rests on the floor, whilst the branch 5, orientated approximately perpendicularly thereto, runs roughly parallel to the working face. On the offset-side rear sides of the branches 5 of the pans 3 there are disposed upper tubular guides 6A and lower tubular guides 6B, here arranged one above the other, through whose cavity return strands of the plough chains, represented only with the respective traction strand, can run. Via catchers, for example on the rear side of the branches 5 of the pans 3, the whole of the plough system 1 can be moved, by means of shifting devices (not further represented), in line with the working progress at the coal face. Since the present application concerns itself neither with the design of supports for the plough system, nor with the shifting devices, these are not represented.

To the lower branch 4 of the pan 3 there is respectively fastened, close to the front end lying directly adjacent to the coal face, a lower guide bar 7A, which in working use runs parallel to the coal face and on which the mining plough, denoted in its entirety by the reference symbol 10, is guided by means of lower guide means, as will be further explained. Each trough pan 2 respectively has a lower guide bar element 7A of this kind, and the guide bar elements 7A of adjacent trough pans 2 can mutually engage or be interlocked in a suitable manner. The lower guide bars 7A are preferably screwed, cast or welded onto the lower branch 4.

In the shown illustrative embodiments, close to the upper end of the branch 5, roughly rectangular brackets 8 are screwed, to which two supporting arms 9 are respectively welded such that they project forward in the direction of the working face, which supporting arms form the support elements for upper guide bars 7B as the upper guide mechanism for the mining plough 10. The upper guide bars 7B lie, vertically offset, opposite the lower guide bars 7A and extend, like the latter, over the entire length of the working face to be worked. As will be further explained, the mining plough 10 is guided by means of identical guide means both on the lower guide bars 7A and on the upper guide bars 7B. The guide bars 7A, 7B are arranged such that they lie opposite one another and have the same distance from the coal face in order that the mining plough with its plough body is transported substantially parallel to the coal face, is supported externally on both sides, and coal can be worked over the whole of the possible working height determined by the height of the plough system 1 and, in particular, of the plough body of the mining plough 10, as well as of the uprising branch 5.

For the movement of the mining plough 10 parallel to the coal face and along the guide bars 7A, 7B of the mining system 1, in the longwall face two separate plough chains 11A, 11B are placed as traction means, both plough chains 11A, 11B consisting of horizontal and vertical chain links and being configured as continuous, revolving chains. The traction strand of each of both plough chains 11A, 11B runs within the slide surface or channel surface of the pans 3, whilst the return strand of both plough chains 11A, 11B runs on the offset side of the pan 3 preferably in the represented tubular guides 6A, 6B, which form chain channels, and is returned to the evacuation section. The plough chain wheels, driven by means of suitable drive mechanisms, for moving the mining plough 10 to and fro in the longwall face by means of the plough chains, are preferably disposed exclusively in the so-called head section at the upper end of the longwall face, whilst the evacuation section, which, because of the steeply stratified coal seam, lies considerably lower down, contains only deflection pulleys for the two plough chains 11A, 11B.

FIGS. 1 and 2 already clearly show that the mining plough 10 has only a relatively small thickness and depth and is substantially wider than it is thick. Both guide bars 7A, 7B have a relatively large distance to the vertically running branch 5 of the pan 3 and the plough body fills the interspace only partially. Since the mining plough 10 is guided with its plough body on guide bars 7A, 7B lying one above the other, virtually no torques are generated in the work effort, which torques would have to be supported by the plough body or the guide bars. The plough body of the mining plough can therefore be given a relatively light construction, so that the mining plough 10, because of reduced weight forces, can be transported to the head section with relatively low installed power. To the person skilled in the art, it will be readily apparent from FIG. 1 that the mining plough 10 can only perform mining work in an upward direction of travel, whilst in downward travel it makes an empty run. Because of the tilt of the individual trough pans, however, the pans 3, even without conveying elements, are able to evacuate the coal to the evacuation section purely on the basis of gravitational forces, since sliding generally sets in from a dip of around 24 gon (21.6 degrees). The movement to and fro of a relatively flat mining plough, which is guided parallel to the coal face on guide bars 7A, 7B arranged vertically one above the other and is moved by means of two separate ploughing chains 11A, 11B, constitutes an innovation for plough systems for steeply stratified coal seams, which plough systems are a precondition for the cost-effective working thereof. The inventive concept is also embodied, however, in the design and structure of the mining plough 10, and its structure will now be described with additional reference to FIGS. 3 to 8.

Figure 3:
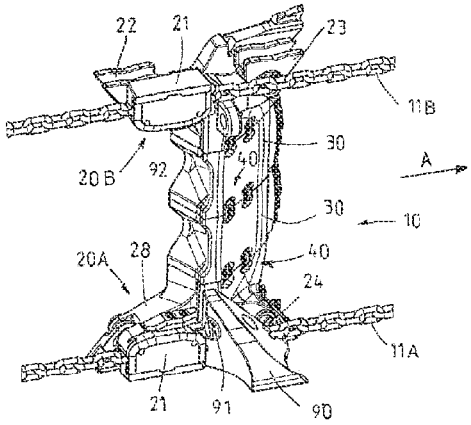
FIG. 3 shows the mining plough from FIG. 1 in a view of the bottom side of the mining plough.

FIGS. 1 to 3, in particular, show that the mining plough 10 has a multipart plough body. In FIGS. 1 to 3, the plough body of the mining plough 10 consists of a lower plough body basic element 20A, an upper plough body basic element 20B and, in this case, two mutually identically configured plough body intermediate elements 30. Only the plough body basic elements 20A, 20B are directly connected to the plough chain, in a tension-proof manner, by a suitable fastener means or fixture 21, which fixture comprises a form-fitting receptacle for a plurality of chain links of the associated plough chain 11A, 11B. The plough body basic elements 20A, 20B are configured in mirror image of each other, and in the following description the respectively identical structural parts configured on both plough body structural elements 20A, 20B are denoted with the same reference symbol. Each plough body basic element 20A, 20B has a front guide element 23 and a rear guide element 22 in the working direction A, which guide elements here respectively consist of slide runners guided on the rectangular guide bars (7A, 7B, FIGS. 1, 2). The front guide means 23 is fastened by a pivot pin 24 pivotably to the plough body basic element 20A, the pivot pin 24 being able to be installed and removed from the bottom side 25 of the plough body basic element 20A, 20B. The slide runner forming the rear guide means 22 is pivotably connected, by a further pivot pin 27 installable from the top side 26 of the plough body basic elements 20A, 20B, to an extending extension 28 of the plough body basic element 20. The extension 28 is integrally configured on the plough body basic element 20 and extends the plough body basic element 20, respectively close to the outer side, by almost double the length to the rear, in order to achieve a sufficiently large distance between the front and rear guide means 23, 22. In the shown illustrative embodiment, as clearly shown by FIG. 3, the detachable fixture 21 for the plough chains 11A, 11B is likewise respectively configured on the extension 28 close to the rear guide elements 22.

Between a plough body intermediate element 30 and a plough body basic element 20 there is in each case a dividing plane T, at which the two elements 20, 30 of the plough body are detachably connected to each other by means of a fastening device 40, the structure of which will be further explained. The extension 28 extends sufficiently far to the rear beyond this dividing plane T between two elements 20, 30 and forms the single extension of the plough body in order that the mining plough, despite the large distance between the front and rear guide means 23, 22, can acquire, all in all, a reduced weight. Since, in FIGS. 1 to 8, the mining plough 10 consists of four elements in all, a further dividing plane is configured between two adjacent plough body intermediate elements 30, a fastening of the adjacent plough body intermediate elements 30 being realized at this dividing plane, too, by means of identical fastening means 40. The construction of the plough body of the mining plough 10 by two outer plough body basic elements 20 or 20A, 20B, which, in order to obtain a minimal working height, could also be directly connected to each other at the dividing plane by means of the fastening means, offers the advantage that, through the choice of a suitable number of intermediate elements, it is possible to attain almost any chosen working height by altering the effective width and/or height of the mining plough 10. By using similar plough body intermediate elements, it is possible, with low stockholding of elements or multiple use of the same, to achieve a cost-effective and variable working of steeply stratified seams.

Figure 4:
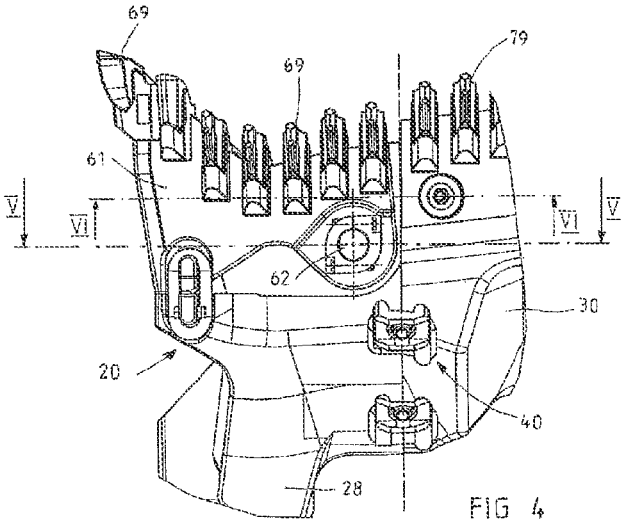
FIG. 4 shows an enlarged top view of one of the plough body basic elements of the mining plough, partially broken open.
Figure 5:
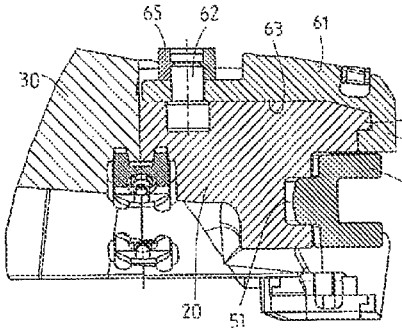
FIG. 5 shows a sectional view along V-V in FIG. 4.

FIG. 4 shows an enlarged top view of a segment of the mining plough 10, a segment of the plough body basic element 20, with the ploughing tools 69 arranged on the front side, being represented on the left and a segment of a plough body intermediate element 30, with the ploughing tools 79 fastened thereto, being represented in the right half. The dividing plane T between the plough body basic element 20 and the plough body intermediate element 30 runs perpendicularly to the height of the mining plough 10. All ploughing tools 69 of the plough body basic element 20 are fastened to a tool carrier 61, which is pivotably fastened to the plough body basic element 20 by a further pivot pin 62. The pivotability of the tool carrier 61 serves in the empty run to pivot the tool tips of the ploughing tools 69 counter to the working direction into a position in which the tool tips of the ploughing tools 69 do not make contact with the coal face. The pivotal guidance of the tool carrier 61 on the plough body basic element 20 can be seen particularly clearly from the sectional view in FIG. 5. The entire bottom surface 63 of the tool carrier 61 rests on the plough body basic element 20 and the pivot pin 62 protrudes from the top of the plough body basic element 20. For the supporting of forces perpendicular to the pin axis of the pivot pin 62, the tool carrier 61 back-grips a guide web 70 on the plough body basic element 20 by means of a hook lug 64. With a clip 65 detachably mounted on the free end of the pivot pin 62, sufficient motional play is left to the tool carrier 61 to assume its two pivot end positions, according to the direction of travel of the plough. The forces transmitted via the ploughing tools 69 are preferably transferred to the plough body basic element 20 via the hook lug 64. The pivot pin 24 for the front guide means 23 is anchored to the plough body basic element 20 beneath the tool carrier 61, as can be seen particularly clearly from FIG. 6.

Figure 7:
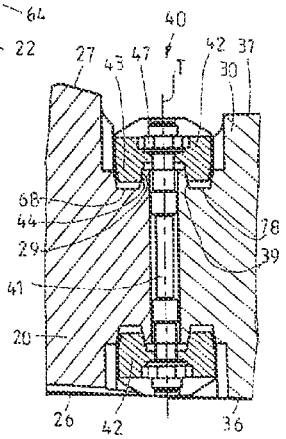
FIG. 7 shows, in an enlarged sectional view through the dividing plane between the plough body basic element and the intermediate element, the fastening elements in detail.
Figure 6:
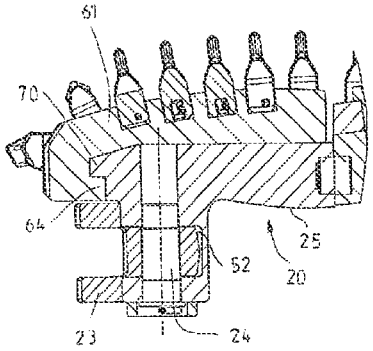
FIG. 6 shows a sectional view along VI-VI in FIG. 4, partially broken open.

The detachable connection between a plough body basic element 20 and a further plough body basic element or a plough body intermediate element 30 is realized by means of fastening means 40, the structure of which is now explained with reference to FIG. 7. Each fastening means 40 has, inter alia, a clamping screw 41 and a threaded shank, the axis of which lies, in the assembled state, within the dividing plane T and extends into locking recesses 68, 78 on the top side 27 and the bottom side 26. Each fastening means 40 additionally consists of two mutually identically configured clamps 42, each of which is of approximately U-shaped configuration and has in the center a passage for the shank of the clamping screw 41. For the clamping or wedging together of two plough body basic elements 20, or of one plough body basic element 20 with a plough body intermediate element 30, each clamp has two clamping branches 43, which are provided on the mutually facing inner faces with clamping surfaces 44 which run in the shape of a wedge, the distance between the clamping surfaces 44 rising with increasing distance from the base of the clamps 42. These clamping surfaces 44 interact with wedge bevels 29 on the plough body basic element 20 and wedge bevels 39 plough body intermediate element 30. The wedge bevels 29, 39 lie respectively, facing away from the dividing plane T, in the region of the locking recesses 68 and 78 on the top sides 27, 37 and bottom sides 26, 36 of the plough body basic elements 20 or plough body intermediate elements 30. Adequate dimensioning of the depth of the locking recesses 68, 78 and the length of the clamping surfaces 44, as well as of the wedge bevels 29, 39, allows a relatively high clamping force to be applied transversely to the dividing plane T by tightening of at least one nut 47. In the shown illustrative embodiment, the clamping screw 41 for each clamp 42 is provided with a separate nut 47, so that the clamping of the fastening means 40 can be realized, according to accessibility, both from above and from below, or else only from one of the two sides.

The arrangement of the ploughing tools 69 on the plough body basic elements 20 and of the ploughing tools 79 on the plough body intermediate elements 30 is realized in such a way that all the ploughing tools 69, 79 are arranged in a roughly W-shaped pattern overall. Adjacent ploughing tools therefore impact in different planes on the mineral to be worked, so that the loosening force of each individual ploughing tool 69 or is able to develop particularly well. The respectively outermost ploughing tools 69 preferably project further in the working direction than all the other ploughing tools 69, 79, as can clearly be seen from FIG. 2. The ploughing tools arranged in the middle of the whole of the plough body in turn stand further forward than all other ploughing tools on the plough body intermediate elements. Behind the ploughing tools, indents or flattenings are configured in the plough body in order to direct into the pan the mineral extracted at the coal face.

The four guide means 23, 22 in all, respectively two guide means 23, 22 being arranged on the lower plough body basic element 20A and two further guide means 23, 22 on the upper plough body basic element 20B, lead in working use, when the mining plough 10 is transported in the working direction A, to the two front guide means 23 and only one of the rear guide means 22 being laden with the supporting forces, according to the resistance of the worked mineral. One of the two rear guide means 22 hence does not for the present come into direct contact with the associated guide bar 7A or 7B, since the distance between the pivot axes of the pivot pins 27 of the rear guide means 22 is preferably slightly less than the distance between the pivot axes of the pivot pins 24. The distance can also, however, be equal. The pivotability of each slide runner as the guide means 23, 22 ensures at all times that the respective slide runner optimally matches the course of the guide bar 7A or 7B.

The mining plough 10 is provided with a driving element 90, which, as can be seen particularly clearly from FIGS. 1 and 3, is configured as a tapered driving block and is pivotably fastened, preferably by a pivot pin, to a fixing eyelet 92, which forms the mounting flange for the driving block 90. The mounting flange 92 lies roughly midway between the pivot pin 24 for the front guide means 23 and the pivot pin 27 for the rear guide means 22. Each plough body basic element 20A, 20B is provided with a fixing eyelet 92.

Figure 8:
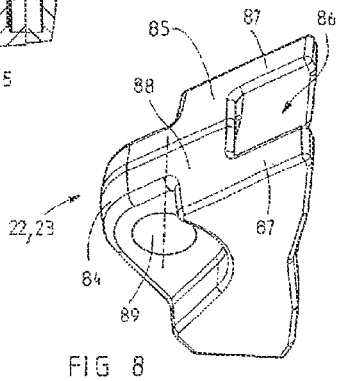
FIG. 8 shows in perspective representation a detailed view of a guide shoe according to the invention.

FIG. 8 shows a preferred illustrative embodiment of a slide runner 85 as the guide means 23 or 22. For interaction with the roughly rectangular cross section of the guide bars (7A, 7B, FIG. 1), the slide runner 85 has a rectangular slotted indent 86, which extends over the entire length of the slide runner 85. The guide slot 86 is delimited on both sides by strong guide branches 87, which merge integrally into a base branch 88 that has on its rear side a hinge eyelet 89 for the passage of the pivot pin 24, 27. The hinge eyelet 89 is configured in the region of a middle web 84, which has roughly the width of the guide recess (51, FIGS. 5 and 52, FIG. 6) on the plough body basic element 20 and, in terms of thickness, is markedly reduced relative to the total thickness of the slide runner 85. As a result of the mutually offset surfaces, shown, by way of example, by FIGS. 5 and 6, the slide runner 85 can be guided into the guide recesses 51 and 52 in the plough body basic element 20 in such a way that it can pivot only perpendicularly to the pivot axis of the associated pivot pin and transverse forces can be absorbed by virtue of a form fit.

Figure 9:
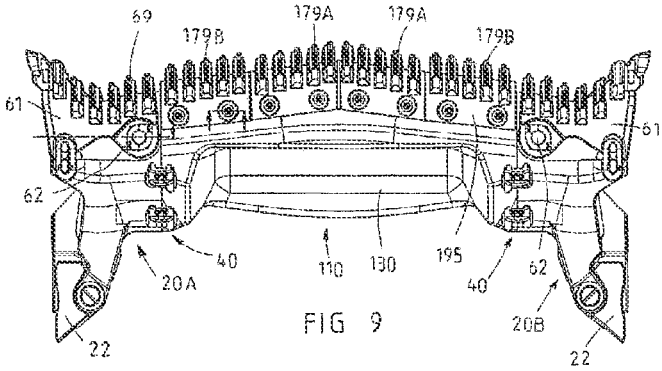
FIG. 9 shows a top view of a mining plough according to a second illustrative embodiment.
Figure 10:
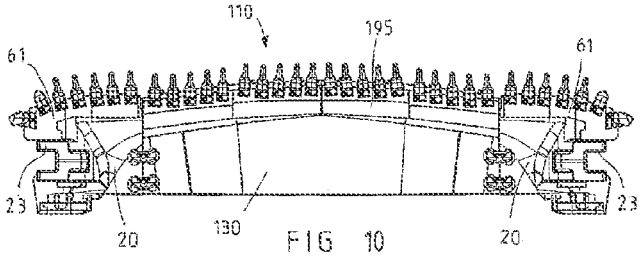
FIG. 10 shows the mining plough from FIG. 9 in a view of the top side.

FIGS. 9 and 10 show further illustrative embodiments of a mining plough 110. As in the previous illustrative embodiment, the mining plough 110 is guided on two mutually opposing guide bars of a plough system, as this is represented in FIG. 1. The plough body of the mining plough 110 comprises two plough body basic elements 20A, 20B, the structure of which is identical to that in the previous illustrative embodiment, so that reference is made to the description given there. Each plough body basic element 20A, 20B is once again provided with rear guide means 22 and front guide means 23, which are fastened pivotably to the plough body basic element 20A, 20B. The ploughing tools 69 of both plough body basic elements 20A, 20B are once again detachably fastened to a tool carrier 61, which can pivot relative to the plough body basic element 20A or 20B about a pivot pin 62. The sole difference between the illustrative embodiments consists in the design of the plough body intermediate element 130, which here consists of a single element, which is respectively externally connected by one end to the plough body basic element 20A and by the other end to the plough body basic element 20B by means of the same fastening means 40, as these have been described further above with reference to the first illustrative embodiment. To the plough body intermediate element 130 there is respectively fastened an inner set of ploughing tools 179A and an outer set of ploughing tools 179B, in the shown illustrative embodiment five of the ploughing tools respectively being fastened to a common tool strip 195. For the replacement of the ploughing tools, only the tool strips 195 need to be removed by the unscrewing of two fastening screws 196 and exchanged for others. FIG. 10 illustrates particularly clearly how flat the mining plough according to the invention 110 can be built overall so as nevertheless to work the coal face over a height here extending to roughly six times the depth.

Figure 11:
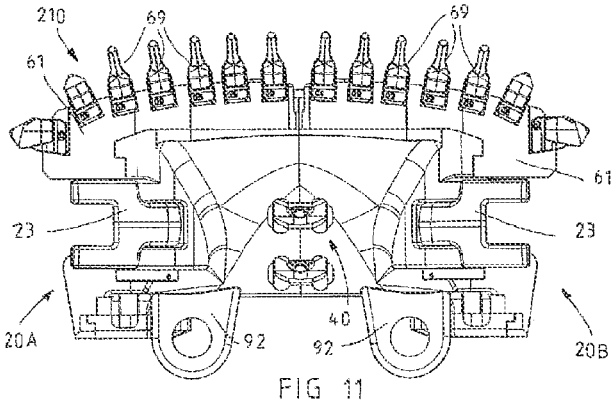
FIG. 11 shows a mining plough from FIG. 9, consisting of plough body basic elements, in a view from the front.

FIG. 11 shows yet further illustrative embodiments of a mining plough 210. As in the previous illustrative embodiments, the mining plough 210 is also guided on two mutually opposing guide bars of a plough system, as this is represented in FIG. 1. The plough body of the mining plough 210 comprises or consists solely of two plough body basic elements 20A, 20B, the structure of which is identical to that in the first illustrative embodiment, so that reference is made to the description given there. Each plough body basic element 20A, 20B is provided with the front guide means 23 discernible in front view, as well as with rear guide means, which are all pivotably fastened to the plough body basic element 20A, 20B. The ploughing tools 69 of both plough body basic elements 20A, 20B are once again detachably fastened to a tool carrier 61, which can pivot relative to the plough body basic element 20A and 20B about a, in this view, non-discernible pivot pin. The two plough body basic elements 20A, 20B are connected with the same fastening means 40 to a plough body of minimal width and thus minimal working height, the depth of the relatively narrowly constructed mining plough amounting to roughly half the working height. A driving block can be mounted on one of the fixing eyelets 92.

For the person skilled in the art, numerous modifications emerge from the preceding description, which modifications shall fall within the range of protection of the appended claims. In a further, non-represented embodiment, a mining plough guided on both sides on guide bars or the like lying one above the other could also consist of a one-piece plough body element. All the advantages of being able to convert the same plough body to different working heights would then, however, be lost.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A mining plough for plough systems for the working of minerals in inclined formation, in particular for the working of coal seams in steep formation, the mining plough comprising:

a separable plough body having two plough body basic elements, each plough body basic element being provided with a fixture for a separate traction chain and with one or more slide runners, for moving the coal plough by way of the traction chains, and for guiding the plough body by way of the slide runners on at least two mutually spaced associated guide bars.

2. The mining plough according to claim 1, wherein the plough body basic elements are connectable directly to each other by fastening clamps to form a plough body having a first working height.

3. The mining plough according to claim 1, further including at least one plough body intermediate element, the at least one plough body intermediate element being connectable to the two plough body basic elements by the fastening clamps to form a plough body of greater working height.

4. The mining plough according to claim 3, wherein each plough body basic element and each plough body intermediate element comprise a lock for the fastening clamps.

5. The mining plough according to claim 1, further including a plurality of plough body intermediate elements, the plurality of plough body intermediate elements being detachably connected or connectable to one another, and the plough body basic elements being detachably connected or connectable to the plough body intermediate elements by the fastening clamps.

6. The mining plough according to claim 3, wherein the fastening clamps comprise U shaped clamps, which are clampable by clamping screws against top and bottom sides on the plough body basic elements or the plough body intermediate elements and, in the assembled state, overlap a dividing plane therebetween.

7. The mining plough according to claim 6, wherein the U-shaped clamps have clamping branches having wedge-shaped, mutually facing clamping surfaces, and the lock is provided with wedge bevels for interaction with the clamping surfaces.

8. The mining plough according to claim 3, wherein the fastening clamps comprise a pair of clamps, the distance between which is variable by way of a clamping screw, whose shank, in the assembled state, is disposed in a dividing plane between the elements to be connected.

9. The mining plough according to claim 1, wherein each plough body basic element has an outer side, on which the associated slide runners are disposed, and an inner side, to which the other plough body basic element or a plough body intermediate element is fastenable thereto.

10. The mining plough according to claim 9, wherein a pair of front and of rear slide runners is respectively arranged one opposite the other on the outer sides.

11. The mining plough according to claim 10, wherein the slide runners are fastened to the plough body basic element pivotably about a pivot pin.

12. The mining plough according to claim 9, wherein the plough body basic elements have on the outer side an extension, which extends rearwards beyond a connecting region on the inner side, in the motional direction, the rear one of the two slide runners of each plough body basic element being fastened to the extension such that it is pivotably movable.

13. The mining plough according to claim 12, wherein the fixture for the respective traction chains is configured on the extension.

14. The mining plough according to claim 1, wherein each plough body basic element is provided with a mounting flange for a driving element configured for the movement of extracted mineral during the empty run.

15. The mining plough according to claim 14, wherein the mounting flange is disposed on a bottom side of the plough body basic element between bearing points for the slide runners, and preferably adjacent to the fixture for the traction chains.

16. The mining plough according to claim 3, wherein on at least one of the plough body basic element and the plough body intermediate element there is configured at least one holding device for the detachable fastening of ploughing tools.

17. The mining plough according to claim 16, wherein the at least one holding device includes a removable tool strip for mounting the ploughing tools.

18. The mining plough according to claim 16, wherein the ploughing tools are disposed on the front side of the plough body, at least one of the ploughing tools close to the inner sides of the plough body basic elements and the ploughing tools on the plough body intermediate elements being set back relative to the ploughing tools on the outer side.

19. The mining plough according to claim 18, wherein the ploughing tools have on the front side, distributed over the height of the plough body, a roughly W-shaped arrangement.

20. The mining plough according to claim 1, wherein each plough body basic element is provided with a pivotable ploughing tool carrier for ploughing tools, all the ploughing tools assigned to a plough body basic element preferably being locked or lockable relative to the pivotable ploughing tool carrier.

21. A plough system for the working of minerals in inclined formation, in particular for the working of coal seams in steep formation, having a mining plough, having at least one fraction means for the movement of the mining plough along a coal face, and having a guide mechanism, which is placed or placeable along a coal face and on which the mining plough is forcibly guided by means of guide means, the mining plough has a separable plough body having two plough body basic elements, each plough body basic element being provided with a fixture for a separate fraction means and with a guide means, and in that the guide mechanism has two guide bars, which are arranged at a distance apart and substantially at equal distance to the coal face and on which the plough body is forcibly guided with its guide means.

22. The plough system according to claim 21, wherein the plough body basic elements are connectable directly to each other by fastening means to form a plough body having a first working height.

23. The plough system according to claim 21, further including at least one plough body intermediate element, the at least one plough body intermediate element being connectable to the two plough body basic elements by the fastening means to form a plough body of greater working height.

24. The plough system according to claim 23, wherein the fastening means is formed by U-shaped clamps, which are clampable by clamping screws against top and bottom sides on the plough body basic elements or the plough body intermediate elements and, in the assembled state, overlap the dividing plane therebetween.

25. The plough system according to claim 24, wherein the clamps have clamping branches having wedge-shaped, mutually facing clamping surfaces, and a lock is provided with wedge bevels for interaction with the clamping surfaces.

26. The plough system according to claim 21, wherein each plough body basic element has an outer side, on which the associated guide means are disposed, and an inner side, to which the other plough body basic element or a plough body intermediate element is fastenable thereto.

27. The plough system according to claim 26, wherein the plough body basic elements have on the outer side an extension, which extends rearwards beyond the connecting region on the inner side, in the motional direction, the rear one of the two guide means of each plough body basic element being fastened to the extension preferably such that it is pivotably movable, the fixture for the respective traction means is configured on the extension.

28. The plough system according to claim 21, wherein each plough body basic element is provided with a pivotable ploughing tool carrier for ploughing tools, all the ploughing tools assigned to a plough body basic element preferably being locked or lockable relative to the pivotable ploughing tool carrier.

29. The plough system according to claim 21, wherein each plough body basic element has a front and a rear guide means, the front and the rear guide means being fastened in a pivotably movable manner to each plough body basic element, and at least the rear guide means, in the assembled state, interacting with the guide bars with motional play in order that the plough body, in working use, receives a 3-point support via three of the four guide means.

30. The plough system according to claim 21, wherein the guide mechanism has an angular or L-shaped pan, the lower guide bar being fastened to a first branch disposed on the floor, and the upper guide bar being fastened by a cantilever arm to a second branch of the pan running angled-off from the lower branch.

* * * * *